United States Patent [19]

Schramm

[11] Patent Number: 4,692,276

[45] Date of Patent: Sep. 8, 1987

[54] NON-ALKALINE, FOAMABLE BATHROOM CLEANER

[76] Inventor: Charles H. Schramm, 53 Black Mount Ct., Fairfield, Conn. 06430

[21] Appl. No.: 783,688

[22] Filed: Oct. 3, 1985

Related U.S. Application Data

[63] Continuation-in-part of Ser. No. 623,494, Jun. 22, 1984, abandoned.

[51] Int. Cl.[4] ..... C11D 1/29; C11D 3/32

[52] U.S. Cl. ..... 252/545; 252/546; 252/548; 252/550; 252/551; 252/553; 252/558; 252/559; 252/DIG. 14

[58] Field of Search ..... 252/545, 546, 548, 550, 252/551, 553, 558, 559, DIG. 14

[56] References Cited

U.S. PATENT DOCUMENTS

| | | | |
|---|---|---|---|
| 3,265,625 | 8/1966 | Grob | 252/546 |
| 3,342,739 | 9/1967 | Corey et al. | 252/548 |
| 3,707,503 | 12/1972 | Kenny | 252/117 |
| 3,914,185 | 10/1975 | Inamorato | 252/546 |
| 3,935,130 | 1/1976 | Hirano et al. | 252/542 |
| 3,951,596 | 4/1976 | Hewitt | 8/137 |
| 3,965,048 | 6/1976 | Murtaugh | 252/527 |
| 4,020,016 | 4/1977 | Sokol | 252/546 |
| 4,087,387 | 5/1978 | Willems et al. | 252/524 |

FOREIGN PATENT DOCUMENTS 519777 12/1955 Canada .

*Primary Examiner*—Prince E. Willis

*Attorney, Agent, or Firm*—Howard E. Thompson, Jr.

[57] ABSTRACT

An aqueous, non-alkaline, foamable bathroom cleaner that is particularly effective in removing lime soap residues and hard water salt deposits from sinks, bathtubs, shower enclosures and metal surfaces, and in maintaining toilet bowls clean when incrementally added to the flush water, comprising:

1. One to 30 percent by weight of an alkyl or alkylethoxy sulfate,
2. One to 15 percent by weight of a long chain alkyl diethanolamide,
3. One to 40 percent by weight of a short chain alkylbenzene sulfonate,
4. Two to 30 percent by weight of nitrilotriacetate or amineacetate,
5. 0 to 12 percent by weight of a conventional nonionic to anionic sulfonate surfactant,
6. 55 to 90 percent by weight of water, and
7. Mineral acid (sulfuric or hydrochloric) to adjust the pH within the range of pH 3–7.

11 Claims, No Drawings

NON-ALKALINE, FOAMABLE BATHROOM CLEANER

This application is a continuation-in-part of pending application Ser. No. 623,494, filed June 22, 1984, now abandoned.

This invention represents a synergistic combination of a surfactant system, on the one hand, and a nitrilotriacetate or amineacetate, on the other, that yields a product possessing the following unusual properties:

(a) Effectiveness in removing lime soap and hard water salt deposits,
(b) Utility over a safe pH range,
(c) Absence of any hazardous or toxic components,
(d) Foam stability,
(e) Biodegradability.

As such, it represents a breakthrough and an advance in the state-of-the-art. The new compositions are based on long chain aliphatic alcohol or ethoxylated alcohol sulfates, amides of long chain fatty acids, hydrotopes and nitrilotriacetates or amineacetates. The sulfates and amides are representative of the surfactant system. It is when the surfactants are combined with the hydrotropes (short chain alkylbenzene sulfonates), and nitrilotriacetates or amineacetates, that an unexpected result is obtained.

The following are examples of the components used in preparing the cleaning compositions of the present invention:

Sodium lauryl sulfate and sodium ethoxylated lauryl sulfate
Lauric mono or diethanolamide
Sodium toluene or xylene sulfonate (hydrotropes)
Sodium nitrilotriacetate or sodium ethylenediamine tetraacetate It has been found that the proper combination of the aforementioned ingredients, when dissolved in water, and adjusted to a pH in the range of 3 to 7, produces a result that is not expected when compared to that of the surfactant system, or that obtained with the nitrilotriacetates or amineacetates when each is tested alone.

Although compositions of this invention can be poured on a surface in liquid form, it is preferred that they be dispensed as a spray.

A very unusual discovery was the finding that the foam stability and viscosity of the subject compositions could be varied by increasing or decreasing the hydrotrope content of the system. In view of the prior art usage of hydrotropes, this could not have been predicted. As such, it is an invention in itself.

Other advantages of the invention will become more apparent upon reading the following description together with the examples which are presented:

BACKGROUND OF THE INVENTION

Relative to the present invention, there are two general types of cleaning compositions presently available on the market; those that are strongly acidic and those that are strongly alkaline. Both types of products are irritating to the skin. In terms of usage, they are not particularly effective in removing lime soap and hard water salt deposits from hard surfaces such as ceramic tile, porcelain and fiberglass sinks, tubs, and shower enclosures. Their foaming characteristics are such that they drain rapidly on vertical surfaces. A product that combines the features of safety, efficacy and performance in removing lime soap and hard water deposits has, heretofore, not been available.

In order to clean lime soap and hard water deposits from bathtubs, shower stalls, sinks, bathroom tile and fixtures, the houseperson has had to resort to the use of scouring powders. These cleaners are abrasive and, over a period of time, will scratch even a porcelain sink or ceramic tile. They are very deleterious on plastic tile, plastic fixtures, fiberglass tubs and sinks, and tile group. Extensive rinsing is required to remove the cleaner powder residues from the substrate. The common anionic and nonionic detergents on the market today are not effective in performing the cleaning operations defined above. They do not remove the residues in question.

It is appreciated that there are no standard tests that are generally accepted for the evaluation of such cleaning compositions. The laboratory tests described in this specification were designed to be as close to actual use conditions as possible. Of particular import in this regard is effectiveness of lime soap and hard water salt removal, safety of use, foam stability and biodegradability. These requirements are all met with compositions of the applicant's invention as will be subsequently described.

As far as safety is concerned, one product currently available on the market, and which represents the state-of-the-art, is Scrub Free (Economics Laboratory, Inc., St. Paul, Minn.). This is a strongly acidic solution of about pH 1.5. It is dispensed as a spray foam. Scrub Free contains sulfamic and hydroxyacetic acids which are described as hazardous materials in the manufacturer's safety data sheets (E. I. duPont de Nemours and Co., Wilmington, Del.). Both acids cause eye burns and contact with the skin is to be avoided.

A second product is Tough Act, a heavy duty bathroom cleaner, marketed by the Dow Chemical Co. (Midland, Mich.). It is representative of the strongly alkaline cleaners, possessing a pH of 11.5. As such, contact with the skin and eyes should be avoided. Two other alkaline cleaners being sold are Fantastik (Texite Chemicals Co., Greenville, S. C.) and Formula 409 (Clorox Co., Oakland, Calif.). In the manufacturers' directions they are recommended for use on tubs, showers, basins and ceramic tile. Both products possess a pH in excess of 11 and they rely on their strongly alkaline properties for cleaning. The warning on the Fantastik label states that the product is not to be used on glass. Formula 409 is not recommended for use on aluminum. The alkalinity of Fantastik and Formula 409 makes them strong eye irritants. In applying the tests used in evaluating the compositions of applicant's invention, it was found that Fantastik and Formula 409 did not remove lime soap or hard water salt deposits.

As far as efficacy is concerned, the cleaners, Scrub Free and Tough Act, rely on their extremely acidic and alkaline character, respectively, for the removal of soap scum, hard water deposits and dirt. They are not effective in the more neutral pH ranges. In fact, it has been found that both products are only partially effective in removing lime soap and hard water deposits in the tests used in evaluating applicant's compositions.

It is a further disadvantage of the aforementioned four products that they attack and corrode many of the surfaces found in bathrooms. The acidic product, Scrub Free, attacks marble and aluminum. In fact, the manufacturer's label contains a warning that Scrub Free should not be used on such surfaces. Alkaline solutions are known to corrode aluminum and Fantastik, Formula 409 and Tough Act, would be expected to do the same.

The compositions of the present invention do not suffer from such deficiencies and, as such, offer a wider spectrum of usage. The cleaning of marble tile and aluminum shower enclosures is not a problem with compositions of the invention.

DESCRIPTION OF THE INVENTION

It has been found, unexpectedly, that there are certain cleaning compositions which can be formulated to be not only effective in removing lime soap and hard water salt deposits, but which do not present the health hazards as previously described. Compositions of the present invention represent an unexpected result with respect to efficacy of use and safety.

Representative ingredients employed in this invention are the alcohol sulfates or ethoxylated alcohol sulfates, alkanolaides, xylene or toluene sulfonates, and nitrilotriacetate or amineacetate salts. The pH at which combinations of these materials are effective ranges from 3 to 7. As such, they are formulated as aqueous solutions to yield stable foam cleaners that are useful in cleaning ceramic tile, glass and porcelain surfaces, sinks and metal objects commonly found in the household.

The surfactant system, as represented by the combination of the organic sulfates, alkanolamides and organic sulfonates (hydrotropes), has been found to be ineffective in removing lime soap and hard water salt deposits. Neither did the nitrilotriacetates or amineacetates, when used alone, perform effectively in this regard. The contribution of the latter in producing the unexpected result of the invention, cannot be attributed to their chelating action. Prior art teaches that nitrilotriacetate is unable to chelate calcium ions at a pH below 8. This is fully described in the Hampshire NTA product brochure, issued by the Organic Chemicals Division, W. R. Grace & Co., Lexington, Mass. Magnesium ions are also not chelated at a pH below 8. It is appreciated that both of these are components of hard water, and as such, are the major contributors to the formation of lime soap deposits.

It was indeed surprising to discover that the surfactant system, when combined with the nitrilotriacetates or amineacetates, yielded a product that met the earlier-defined criteria.

Another unexpected finding of the invention was that the foam stability and, therefore, convenience of use, of the cleaning composition was vastly improved by the use of the common hydrotropes, xylene or toluene sulfonates, for example. These products were found to be very useful in generating a thick, stable foam when combined with the other components of subject invention. These foams were generated with a commonly used sprayer of the "Contico" type. Hydrotropes, in the state-of-the-art formulation of detergents, are used to dissolve the detergent system during the manufacturing process. They have, heretofore, not been described as foam stabilizers, or foam thickeners. The foam thickeners commonly employed are the polyethyleneglycols in the molecular weight range of from 150 to 6,000 and are described in U.S. Pat. No. 2,927,081 to C. H. Schramm, dated Mar. 1, 1960, column 6, lines 58 to 65.

With respect to the composition of the products used in the examples of the invention, the following is illustrative:

(a) Alcohol sulfates and ethoxylated alcohol sulfates of the following structure:

$$RO(CH_2CH_2)_nSO_3X$$

where R is a straight chain hydrocarbon radical having from about 10 to 18 carbon atoms, n is a number from 0 to 6 and X is sodium potassium, hydrogen, ammonium, alkylammonium and alkanolammonium. Included are amines such as the mono-, di- and trimethyl, ethyl and propylamines. Alkanolamines include ethanolamine, diethanolamine and triethanolamine, and the corresponding propanolamines. Quantities used in the formulation of the products of the invention can range from 1 to 30 percent by weight.

(b) Alkyl and alkanolamides of the structure $$RCON(R')(R'')$$

where R is a straight chain hydrocarbon radical having from about 9 to 19 carbon atoms, R' and R'' can be hydrogen, hydroxyethyl, hydroxypropyl, and alkyl, with the latter having from about 1 to 4 carbon atoms. The amino component can thus be based on ammonia, ethanolamine, diethanolamine, methylethanolamine, methylamine, dimethylamine, ethylamine, diethylamine, isopropanolamine and methylisopropanolamine. Ranges of the amide component in the formulation can be from about 1 to 15 percent. RCO can by lauroyl, myristoyl, palmitoyl, cetoyl, and mixtures of fatty acyls derived from naturally occurring fats and oils, such as coconut oil and palm oil, consisting predominantly of 10 to 16 carbon atom acids.

(c) Short chain alkylbenzene sulfonates (hydrotropes) of the structure:

$$RSO_3X$$

where R is toyl, xylyl and cumyl, X is sodium, potassium, hydrogen, ammonium, alkylammonium and alkanolammonium. Additional definitions of X are described in (a) of this section. About 1 to 40 percent by weight of the sulfonate can be used.

(d) Nitrilotriacetates of the structure $$N(CH_2COOX)_3$$

where X is sodium, potassium, hydrogen, ammonium, alkanolammonium, alkylammonium, and alkylalkanolammonium.

Amineacetates can be used as a replacement for the nitrilotriacetates in the formulation. Representative amineacetates are ethylenediamine tetraacetate (EDTA) salts of the formula $$(XOOCCH_2)_2NCH_2CH_2N(CH_2COOX)_2$$ and N-hydroxyethylethylenediamine triacetate (HEEDTA) salts of the structure $$\begin{array}{l} XOOCCH_2 \\ \qquad\qquad\quad \diagdown \\ \qquad\qquad\quad NCH_2CH_2N(CH_2COOX)_2 \\ \qquad\qquad\quad \diagup \\ HOCH_2CH_2 \end{array}$$

where X is defined as above.

About 2 to 30 percent by weight of these components can be employed.

(e) Water about 55 to 90 percent by weight (f) pH Range

The pH range of the cleaning composition can be from about 3 to 7, and pH is adjusted by addition of a small amount of mineral acid such as sulfuric or hydrochloric acid. It is of import to note that the pH of tap water is approximately 5.5 which is also the pH of human skin. It is of significance that the products of the present invention are effective in cleaning and safe to use, in this range.

Of particular importance in the exploration of this discovery have been experiments conducted according to a technique developed by Irving Langmuir in measuring the surface activity of unimolecular layers on water surfaces. This approach can be adapted to studying the effectiveness of cleaning compositions in dispersing and removing lime soap. Monolayers of fatty acid soap can be spread on the surface of water in a Langmuir trough, and the monolayer of the surfactant can be picked up on a clean glass plate. When hard water (Bridgeport municipal water supply) is used in such an experiment, the surfactant soap which is now present as an insoluble calcium and magnesium soap (lime soap), is transferred to the glass plate. When this plate is allowed to dry at room temperature, it forms a coating and as such, is a very useful substrate for testing the lime soap and hard water salt removal action of cleaning compositions.

The following is a representative formulation of the present invention which was used in the experiments on removing lime and hard water salts from the Langmuir trough-soiled plates:

EXAMPLE 1

| | Percent by weight |
|---|---|
| Sodium laureth sulfate | 5 |
| Lauric ethanolamide | 2.5 |
| Sodium xylene sulfonate | 10 |
| Sodium nitrilotriacetate | 5 |
| Water | 77.5 |

pH adjusted to 5.5 with sulfuric acid

Laureth is defined as lauryl alcohol which has been reacted with 2.5 moles of ethylene oxide.

This formulation, when sprayed on the test plates completely removed the deposits, whereas the two commercially available products, Scrub Free and Tough Act, left residues amounting to approximately 50% of the plate surface. Furthermore, the latter two products did not drain free when rinsed with water. As such, they were found to be more easily resoiled than compositions of the present invention.

A second formulation, based on sodium lauryl sulfate, also performed well in the test. Its composition was as follows:

EXAMPLE 2

| | Percent by weight |
|---|---|
| Sodium lauryl sulfate | 10 |
| Lauric diethanolamide | 3 |
| Ammonium xylene sulfonate | 10 |
| Sodium nitrilotriacetate | 7 |
| Water | 70 |

pH adjusted to 5.0

Mixed amides, such as those based on coconut oil fatty acids, can also be used. The following formulation is representative:

EXAMPLE 3

| | Percent by weight |
|---|---|
| Sodium laureth sulfate | 10 |
| Coconut diethanolamide | 3 |
| Sodium cumene sulfonate | 10 |
| Ammonium nitrilotriacetate | 3 |
| Water | 74 |

pH adjusted to pH 4.0

The composition of Example 3 was equivalent to Example 1 in the lime soap and hard water deposit test.

Any formulation, in which the diethanolamine salt of lauryl alcohol sulfate was used:

EXAMPLE 4

| | Percent by weight |
|---|---|
| Lauryl diethanolammonium sulfate | 15 |
| Myristic diethanolamide | 3 |
| Sodium toluene sulfonate | 20 |
| Ammonium nitrilotriacetate | 5 |
| Water | 57 |

pH adjusted to 7.0 removed all of the deposit on the test plates.

It is appreciated that there are many variations and combinations of the components that can be formulated. Repeated tests showed that, within the limits specified by applicant's invention, there were no significant differences in the results obtained in evaluating the products in the soiled plate tests.

The lime soap dispersant action of the invention was also tested in a white porcelain bathroom sink in the following manner: The sink was filled with tap water at a temperature of 100° F. A one-inch ribbon of Palmolive Lather Shaving Cream was dispersed in the water until a continuous lime soap film was generated. This film is commonly referred to as "lime soap scum" and is the major contributor to the formation of bath tub ring, shower deposits and, in general, residues where soap and hard water salts come into contact. Even water of a low degree of hardness as New York City municipal water, generates soap scum when brought into contact with soap. When 10 ml. of the solution of Example 1 was added to the sink, the lime soap scum was completely dispersed and a clear solution was obtained. When the sink was drained, no residues remained. Scrub Free, on the other hand, increased the opacity of the sink mixture and upon standing deposited soap scum on the sides of the sink. When the sink was drained, deposits of lime soap remained. Tough Act caused the soap scum to coagulate and deposit on the sides of the sink. Upon draining the sink, the curds of lime soap remained. This is clear evidence supporting the superiority of the invention compositions in dispersing the deposits formed from fatty acid soaps as used in everyday washing operations.

The mechanism of lime soap and hard water salt removal from hard surfaces is not completely understood or defined. One of the known lime soap dispersants is PEGTA sulfate.

$RCONH(CH_2CH_2O)SO_3Na$ 3.5 which is based on RCO as being derived from tallow fatty acids and the amine residue coming from Alkanolamine 175 (Union Carbide). The terminal hydroxyl group of the latter is sulfated to provide water solubility and surface activity. PEGTA sulfate has been incorporated in soap bar formulations to provide a modicum of lime soap dispersant action in reducing the formation of "bath tub ring". However, this is in contradistinction to present invention compositions which actually remove previously-formed "bath tub ring" and other deposits from bath tubs, sinks and shower enclosures. It is furthermore noted that PEGTA sulfate is too expensive to be of commercial usage.

An additional advantage of the composition of the present invention is that these products possess excellent properties when used on tile, metal, ceramic and glass surfaces. This is of importance when these surfaces are rinsed with water so that rapid and uniform drainage is obtained. Beads of water left on the surface, upon evaporation, leave residues of salts which subsequently become the nuclei for more deposition of lime soap and hard water salts. An insight into this can be obtained by measuring the wetting angle of the water residues after rinsing. Comparisons of Scrub Free with the Example 1 product showed that the former formed droplets of water having a three times greater wetting angle than the droplets formed by Example 1. A lower power microscope of 10% magnification was used for these measurements. These experiments were conducted on vertical glass, chromium, aluminum, and stainless steel surfaces.

An unexpected result was obtained with compositions of subject invention in the cleaning of tile grout It was found that mildew, iron and algae deposits were floated out of the grout crevices after treatment with these formulations. Similar results were obtained in the cleaning of aluminum channel of shower doors. The mechanism of this action is not evident at this time It does not appear to be a dispersant action alone, but also an attack on the bonding which holds these types of deposits on the hard substrate The commercial samples, Tough Act and Scrub Free, did not produce these results.

Formulations of the present invention have also been found to be effective in cleaning and preventing resoiling when dispensed into toilet bowls. In this use, small amounts (one to five millimeters) per flush of the composition are dispensed into the toilet tank by any one of the commercially-available dispensers. This produces a flush of foamy water which not only cleans the toilet bowl but also retards resoiling of the bowl until the contents of the dispenser are used up. Depending on the number of flushes, the bowl remains clean for a period of one to three months.

The discovery of hydrotropes in thickening and stabilizing foams is an essential part of this invention. These hydrotropes were particularly effective in this regard:

Sodium xylene sulfonate
Sodium toluene sulfonate
Sodium cumene sulfonate with the former being the preferred product. The sodium salts of benzene sulfonate, ethylbenzene sulfonate and isopropylbenzene sulfonate can also be employed.

The test used in evaluating the hydrotropes with respect to foam viscosity and stability consisted of measuring drainage rates when subject compositions were sprayed on a vertical ceramic tile surface. An area eight inches was sprayed across the tile, and the time for the foam to reach the bottom of the surface was measured. The vertical distance was 20 inches. A "Contico" sprayer was used as the dispensing device. The drainage rates, compared to Tough Act and Scrub Free, were as follows:

| | Time in seconds |
|---|---|
| Tough Act | 8 |
| Scrub Free | 6 |
| Example 1 | 38 |

The significance of this result is that the houseperson has a longer time to clean a surface with the slower draining product. With respect to foam stability, even after five minutes, the foam of the Example 1 composition was still present on the tile surface.

It has, furthermore, been found that increasing the amount of the sulfonate to 20 percent of the formula in Example 1, generated a foam of such viscosity that it did not drain at all. At 30 percent sulfonate content, the foam had the consistency of shaving cream. The formulation used in the latter test was:

EXAMPLE 5

| | Percent by weight |
|---|---|
| Ammonium laureth sulfate | 5 |
| Lauric diethanolamide | 2.5 |
| Sodium xylene sulfonate | 30 |
| Sodium nitrilotriacetate | 5 |
| Water | 57.5 |

pH adjusted to 5.0

Prior art would teach that, due to the increased ionic strength or polarity of the medium, the viscosity of the foam would be decreased and, therefore, the drainage rate would be faster.

With respect to exploring the limits of the quantities of the sulfates, amides and nitrilotriacetates or amineacetates, it is obvious to those skilled in the art, that considerable range is possible. Holding other components at a constant level, for example, the following is pertinent to the invention:

(a) The lauryl alcohol sulfate and ethoxylated lauryl alcohol sulfate can be increased to 30 percent with no perceptible change in the removal of lime soap and hard water deposits. An expected increase in foam volume and viscosity is obtained. In approaching the lower level of about 1 percent sulfate, foam volume drops, but the product is still effective in removing lime soap and hard water salt deposits.

(b) The amount of the amide component, such as lauric diethanolamide, can be varied from about 1 to 15 percent. At the lowest level, the only effect is that the foam, although still acceptable, is less viscous than that of the Example 1 composition.

(c) Variations in the nitrilotriacetate or amineacetate salt content have been found to have no effect in removing lime soap and hard water salt deposits, at percentage levels down to about 2 percent. Increasing the amount of nitrilotriacetate to 30 percent removed the deposits as well as the composition of Example 1.

As will also be understood by those skilled in the art, other biodegradable surfactants, such as conventional nonionic and anionic sulfonate surfactants, can be substituted in part, for the alcohol sulfates or the ethoxylated alcohol sulfates of the invention compositions to account for up to 12 percent by weight thereof.

Typical of such nonionics are ethoxylated straight chain alcohols of the formula:

$$RO(CH_2CH_2O)_nH$$

where R is a straight chain hydrocarbon radical having from about 10 to 18 carbon atoms, and n is a number from about 1 to 10

EXAMPLE 6

| | Percent by weight |
|---|---|
| Sodium lauryl sulfate | 5 |
| Sodium cumene sulfonate | 15 |
| Ethoxylated lauryl alcohol (n = 10) | 5 |
| Lauric diethanolamide | 3 |
| Sodium nitrilotriacetate | 10 |
| Water | 62 |

pH adjusted to 5.0

EXAMPLE 7

| | Percent by weight |
|---|---|
| Ammonium laureth sulfate | 5 |
| Ethoxylated nonylphenol (10 EtO) | 3 |
| Sodium xylene sulfonate | 10 |
| Lauric diethanolamide | 3 |
| Sodium nitrilotriacetate | 8 |
| Water | 71 |

pH adjusted to 5.5 with hydrochloric acid

These formulations performed as well as the composition of Example 1 in the lime soap and hard water salt removal test. The foam characteristics, although still acceptable, were of a slightly lower level and viscosity than those of Example 1.

Additionally, the commonly-used linear alkylbenzene sulfonates of the structure

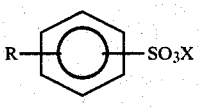

where R is a linear alkyl radical having from about 10 to 18 carbon atoms and X is a cation as previously defined in this specification, can also be substituted in part, for the alcohol sulfate or ethoxylated alcohol sulfate of the invention composition. A typical formula is:

EXAMPLE 8

| | Percent by weight |
|---|---|
| Ammonium laureth sulfate | 2 |
| Sodium dodecylbenzene sulfonate | 12 |
| Lauric diethanolamide | 4 |
| Sodium xylene sulfonate | 10 |
| Sodium nitrilotriacetate | 7 |
| Water | 65 |

pH adjusted to 6.0

The above formulation was equal to the product of Example 1 in removing lime soap and hard water deposits. Its foam characteristics were equal to those of Example 6.

It is appreciated that in formulating the compositions of the present invention, the percent by weight of the individual components is adjusted so as not to exceed their solubility in the water present in the composition.

Typical amineacetate formulations which have been found to be effective in removing lime soap and hard water salt deposits are:

EXAMPLE 9

| | Percent by weight |
|---|---|
| Ammonium laureth sulfate | 5 |
| Lauric diethanolamide | 2 |
| Ammonium xylene sulfonate | 8 |
| Disodium ethylenediamine tetraacetate | 10 |
| Water | 75 |

pH adjusted to 5.5 with sulfuric acid.

EXAMPLE 10

| | Percent by weight |
|---|---|
| Ammonium lauryl sulfate | 3 |
| Lauric diethanolamide | 1.5 |
| Sodium xylene sulfonate | 7.5 |
| Ammonium N—hydroxyethylethylenediamine triacetate (HEEDTA) | 8 |
| Water | 80 |

pH adjusted to 4.0 with sulfuric acid

As far as the limits on the amount of water are concerned, it has been found that formulations containing up to 90% water are still effective. The following is illustrative:

EXAMPLE 11

| | Percent by weight |
|---|---|
| Ammonium laureth sulfate | 2 |
| Lauric diethanolamide | 1 |
| Ammonium xylene sulfonate | 3 |
| Diammonium ethylenediamine tetraacetate | 4.5 |
| Water | 89.5 |

pH adjusted to 5.0 with sulfuric acid.

Having reference to the earlier listing of components a to f, the conditions considered preferable in the practical application of the present invention are as follows:

Component a - 5–15% by weight
Component b - 2–9% by weight
Component c - 10–30% by weight
Component d - 4–15% by weight
Component e - 55 to 75% by weight
Component f - acid to provide a pH of 5.0–6.5

In such preferred formulation it will be noted that none of the "conventional" nonionic or ionic sulfonate surfactants are employed in partial substitution for component "a".

Various changes are modifications in the compositions herein disclosed may occur to those skilled in the art; and to the extent that such changes and modifications are embraced by the appended claims, it is to be understood that they constitute part of the present invention.

I claim:

1. An aqueous, non-alkaline, spray foamable bathroom cleaning composition that is particularly effective in removing lime soap residues and hard water salt deposits from sinks, toilet bowls, bathtubs, shower enclosures and metal surfaces, said cleaning composition consisting essentially of:

a. 1 to 30% by weight of a substance selected from the group consisting of alcohol sulfates of the formula $$RO(CH_2CH_2O)_nSO_3X$$

where R is a straight chain hydrocarbon radical having from about 10 to 18 carbon atoms, n is a number from 0 to 6 and X is sodium, potassium, hydrogen, ammonium, mono-, di-, and tri-lower alkylammonium, and alkanolammonium in which lower alkyl and alkanol embrace methyl, ethyl and propyl;

b. 1 to 15% by weight of a substance selected from the group consisting of alkyl and alkanolamides of the structure $$RCON(R')(R'')$$

where R is a straight chain hydrocarbon radical having from about 9 to 19 carbon atoms, R' and R'' can be hydrogen, hydroxyethyl, hydroxypropyl, and alkyl, with the latter having from about 1 to 4 carbon atoms;

c. 1 to 40% by weight of a substance selected from the hydrotropes consisting of short chain alkylbenzene sulfonates of the formula $$RSO_3X$$

where R is tolyl, xylyl and cumyl, X is sodium, potassium, hydrogen, ammonium, alkylammonium and alkanolammonium as described in (a) above;

d. 2 to 30% by weight of a nitrilotriacetate of the formula $$N(CH_2COOX)_3$$

or, an amineacetate of the formulae $$(XOOCCH_2)_2NCH_2CH_2N(CH_2COOX)_2,$$

and

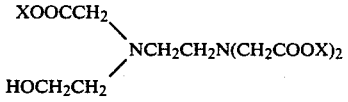

where X is sodium, potassium, hydrogen, ammonium, alkanolammonium, alkylammonium, and alkylalkanolammonium, whee the alkyl and alkanol groups are as described in (a) above.

e. 0 to 12% by weight of a conventional nonionic or anionic sulfonate surfactant f. 55 to 90% by weight water, and g. an amount of mineral acid (sulfuric or hydrochloric acid) to provide a pH within the range of pH 3 to 7.

2. An aqueous, non-alkaline, spray foamable bathroom cleaning composition as defined in claim 1, wherein said cleaning composition preferably contains:

Component "a" - 5–15% by weight
Component "b" - 2–9% by weight
Component "c" - 10–30% by weight
Component "d" - 4–15% by weight
Component "e" - 0% by weight
Component "f" - 55–75% by weight
Component "g" - Acid to provide a pH of 5.0–6.5.

3. A spray foamable bathroom cleaning composition as defined in claim 1, wherein foam stability and viscosity are respectively increased or decreased by increasing or decreasing the amount of component "c" within the stated range.

4. A spray foamable bathroom cleaning composition as defined in claim 1, wherein the "X" substituent of component "c" is sodium, potassium or ammonium.

5. A spray foamable bathroom cleaning composition as defined in claim 1, wherein the "X" substituent of component "d" is sodium, potassium or ammonium.

6. A spray foamable bathroom cleaning composition as defined in claim 1, wherein component "d" is a nitrilotriacetate.

7. A spray foamable bathroom cleaning composition as defined in claim 1, wherein component "d" is an ethylenediamine tetracetate.

8. A spray foamable bathroom cleaning composition as defined in claim 1, wherein component "d" is an N-hydroxyethyl ethylenediamine triacetate.

9. A spray foamable bathroom cleaning composition consisting by weight of:

| | |
|---|---|
| Sodium laureth sulfate | 5% |
| Lauric ethanolamide | 2.5% |
| Sodium xylene sulfonate | 10% |
| Sodium nitrilotriacetate | 5% |
| Water | 77.5% |
| Sulfuric acid to | pH 5.5 |

10. A spray foamable bathroom cleaning composition consisting by weight of:

| | |
|---|---|
| Ammonium laureth sulfate | 5% |
| Lauric diethanolamide | 2.5% |
| Sodium xylene sulfonate | 30% |
| Sodium nitrilotriacetate | 5% |
| Water | 57.5% |
| Sulfuric acid to | pH 5.0 |

11. A spray foamable bathroom cleaning composition consisting by weight of:

| | |
|---|---|
| Ammonium laureth sulfate | 5% |
| Lauric diethanolamide | 2% |
| Ammonium xylene sulfonate | 8% |
| Disodium ethylenediamine tetraacetate | 10% |
| Water | 75% |
| Sulfuric acid to | pH 5.5 |

* * * * *

UNITED STATES PATENT AND TRADEMARK OFFICE

CERTIFICATE OF CORRECTION

PATENT NO. : 4,692,276

DATED : September 8, 1987

INVENTOR(S) : Charles H. Schramm

It is certified that error appears in the above-identified patent and that said Letters Patent is hereby corrected as shown below:

Column 1, line 21, "hydrotopes" should read -- hydrotropes --.

Column 2, line 41, "Texite" should read -- Texise --.

Column 3, line 20, "Alkanolaides" should read -- alkanolamides --.

Column 4, line 4, "$RO(CH_2CH_2)_nSO_3X$" should read -- $RO(CH_2CH_2O)_nSO_3X$ --.

Column 4, line 39, "toyl" should read -- tolyl --.

Column 7, line 1, "$RCONH(CH_2CH_2O)SO_3Na$ 3.5" should read

-- $RCONH(CH_2CH_2O)_{3.5}SO_3Na$ --.

Column 7, line 30, "lower" should read -- low --.

Column 7, line 31, "10%" should read -- 10X --.

Column 11, line 60, "whee" should read -- where --.

Column 12, line 30, "tetracetate" should read -- tetraacetate --.

Signed and Sealed this

Sixteenth Day of February, 1988

*Attest:*

*Attesting Officer*

DONALD J. QUIGG

*Commissioner of Patents and Trademarks*